United States Patent [19]

Ichiyanagi

[11] 4,118,922

[45] Oct. 10, 1978

[54] ELECTRONIC WATCH OR CLOCK AND ACCESSORY DEVICES THEREFOR

[75] Inventor: Toshikazu Ichiyanagi, Tokyo, Japan

[73] Assignee: Canon Kabushiki Kaisha, Tokyo, Japan

[21] Appl. No.: 753,016

[22] Filed: Dec. 21, 1976

[30] Foreign Application Priority Data

Dec. 27, 1975 [JP] Japan ..... 50/156677

[51] Int. Cl.[2] ..... G04C 3/00

[52] U.S. Cl. ..... 58/23 BA; 58/85.5; 58/50 R

[58] Field of Search ..... 320/2, 5; 58/23 R, 23 BA, 58/50 R, 85.5

[56] References Cited

U.S. PATENT DOCUMENTS

| | | | |
|---|---|---|---|
| 2,974,474 | 3/1961 | Wegner | 58/50 R |
| 3,214,670 | 10/1965 | Schaf | 58/23 BA X |
| 3,509,714 | 5/1970 | Walton | 58/23 R |
| 3,540,209 | 11/1970 | Zatsky et al. | 58/50 R |
| 3,777,471 | 12/1973 | Koehler et al. | 58/23 R |
| 3,895,486 | 7/1975 | Hammer et al. | 58/23 R |
| 3,968,417 | 7/1976 | Dials | 320/2 |

FOREIGN PATENT DOCUMENTS

| | | | |
|---|---|---|---|
| 744,449 | 7/1958 | France | 58/23 BA |
| 368,428 | 3/1963 | Switzerland | 58/23 BA |

*Primary Examiner*—Ulysses Weldon

*Attorney, Agent, or Firm*—Toren, McGeady and Stanger

[57] ABSTRACT

An electronic watch or clock having incorporated therein an electrical power source battery, an oscillator producing a train of timing pulses at a predetermined frequency and either of a counter for counting the timing pulses supplied from said oscillator and driving means responsive to the timing pulses for driving the hands, whereby the clocking is effected based on the oscillation frequency of the aforesaid oscillator. This electronic watch or clock is provided with electrical connection terminals arranged to be connectable with either of an accessory device for charging the aforesaid battery and an accessory device for compensating clocking shift error so that upon selective connection to these accessory devices, the charging of the battery and/or the compensation of the clocking shift error can be made through the above mentioned connection terminals.

10 Claims, 8 Drawing Figures

ELECTRONIC WATCH OR CLOCK AND ACCESSORY DEVICES THEREFOR

BACKGROUND OF THE INVENTION

1. Field of the Invention

This invention relates to an electronic watch or clock in which the clocking is effected based on the pulse signal produced at a predetermined frequency from a pulse oscillator.

2. Description of the Prior Art

In general, electronic watches or clocks operate with pulse oscillators capable of producing a train of pulses at a predetermined frequency which are then counted by a counter to effect clocking. For this purpose, there is a vital need of an electrical power source for driving the pulse oscillator and counter.

In the conventional electronic watches or clocks, however, because of their using batteries such as mercury batteries as said electrical power source, there arises a necessary manipulation for exchanging the battery with a new one when the voltage of the electrical power source battery has dropped below a predetermined level. As the watch or clock must be made air-tight shielded, the battery is usually incorporated within an air-tight casing so that when the battery is exchanged, the back cover of the watch casing must be opened by a specialist. This is very inconvenient for the user.

Further, in the electronic watches or clocks, when a timing shift error occurs, a push button, or Lüz is manipulated to compensate for the timing shift error. Usually, these operating members are arranged to be accessible with ease from the outside of the watch or clock so that when these operating members are accidentally operated by contact with the cloth or other external material bodies, the clocking is caused to shift.

SUMMARY OF THE INVENTION

With the foregoing in mind, the present invention has for the general object to provide a novel electronic watch or clock which has overcome the above mentioned conventional drawbacks.

A first important object of the present invention is to provide a novel electronic watch or clock having incorporated therein an electrical power source battery capable of beng charged.

A second important object of the invention is to provide a novel electronic watch or clock having no operating member such as a push button or Lüz, while nevertheless being capable of compensating clocking shift error electrically.

According to the present invention, there is proposed a novel electronic watch or clock having incorporated therein an electronical power source battery, an oscillator producing a train of timing pulses at a predetermined frequency and either of a counter for counting the timing pulses supplied from said oscillator and driving means responsive to said timing pulses for driving the clock hands so that the clocking is effected based on the oscillating frequency of said oscillator, wherein there are provided electrical connection terminals arranged to be connectable with either of an accessory device for charging said electrical power source battery and an accessory device for compensating clocking shift error electrically so that upon selective connection with these accessory devices, the charging of said battery and/or the compensation for the clocking shift error can be made through said connection terminals.

Further, according to the present invention, there are also proposed in combination with the above mentioned electronic watch or clock an accessory device for charging the above mentioned electrical power source battery for use with said electronic watch or clock and/or an accessory device for compensating clocking shift error electrically.

These and other objects and features of the present invention will become apparent from the following detailed description taken in conjunction with the accompanying drawings in which:

DETAILED DESCRIPTION OF THE PREFERRED EMBODIMENTS

Figure 1:
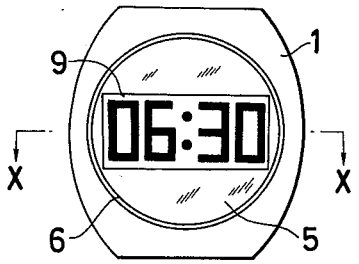
FIG. 1 is an elevational view of one embodiment of an electronic watch according to the present invention.
Figure 2:
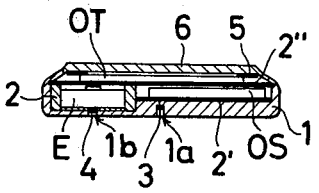
FIG. 2 is a sectional view taken along a line X—X of FIG. 1.

Initially, one embodiment of an electronic watch according to the present invention will be explained below. In FIGS. 1 and 2, 1 is a casing of the watch having incorporated therein a pulse oscillator OS for producing a train of timing pulses at a predetermined frequency (in this instance, one timing pulse every 1 minute), an output device capable, upon counting of the pulses from said pulse oscillator OS, of displaying the time, and an electrical power source battery E such as Ni-Cd (Nickel-Cadmium) battery capable of being charged for providing electrical power to said pulse oscillator OS and output device OT, these parts being electrically insulated from each other by insulating members 2, 2' and 2''. This watch is provided with a pair of electrical connection terminals 3 and 4 mounted at the bottom ends of respective recessed portions 1*a* and 1*b* and arranged to be connectable with either of the accessory devices adapted for use with said electronic watch, for example, the accessory device for charging the above mentioned electrical power source battery E, or the accessory device for compensating clocking shift error. (It is to be noted here that one of the connection terminals, for example, terminal 4 may be omitted provided that the casing 1 has an internal conductive plate, a portion of which is exposed to the recessed portion 1*b* to permit the direct use of it as the connection terminal instead of the terminal 4). 5 is a masking plate arranged in front of said output device OT to admit for the user the visualization of only display means 9 of said output device OT (in this instance, digital display means comprised of the so-called seven-segment, for example, Light Emitting Diodes), and 6 is a glass disc serving as an external protector.

Next, by reference to FIGS. 3A and 3B, the construction of the electric circuit of the above mentioned electronic watch will be explained.

Figure 3A:
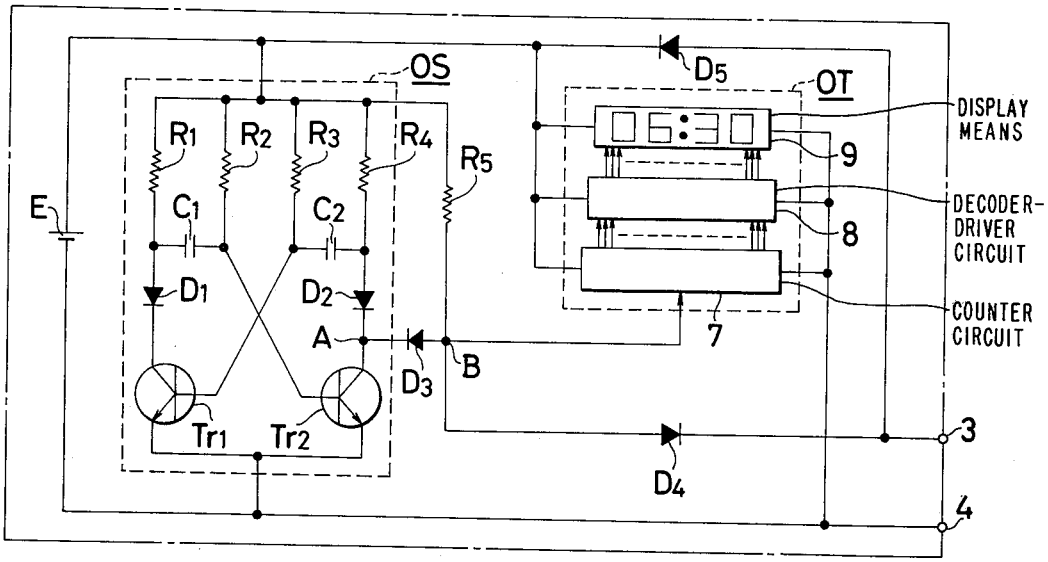
FIG. 3A is a schematic diagram, partly in block form, of an electric circuit incorporated in the electronic watch of FIGS. 1 and 2.

FIG. 3A shows the above mentioned pulse oscillator OS to be an astable multi-vibrator comprising transistors $Tr_1$ and $Tr_2$, resistors $R_1$, $R_2$, $R_3$ and $R_4$, condensors $C_1$ and $C_2$ and diodes $D_1$ and $D_2$. This astable multivibrator is constructed so that, upon supply with electric power from the battery E, timing pulse every 1 minute is produced from its output terminal A. The above mentioned output device OT is shown as comprising a counter circuit 7 connected through a diode $D_3$ to the output terminal A of the aforesaid pulse oscillator OS for counting the pulse signal generated from said pulse oscillator OS, and a decoder-driver circuit 8 connected to said counter circuit 7 for converting the number of pulses counted by said counter circuit 7 to the corresponding digital code for display to drive the aforesaid digital display means 9 for the purpose of displaying the time.

$R_5$ is a resistor connected between a point B in connection between the aforesaid counter 7 and diode $D_3$ and the (+) electrode of the aforesaid electrical power source battery.

The aforesaid connection terminal 3 is connected through reverse-current-preventing diodes $D_4$ and $D_5$ to both of the aforesaid connection point B and the (+) electrode of the battery E respectively, while the aforesaid connection terminal 4 is connected to the (−) electrode of the battery E.

Figure 3B:
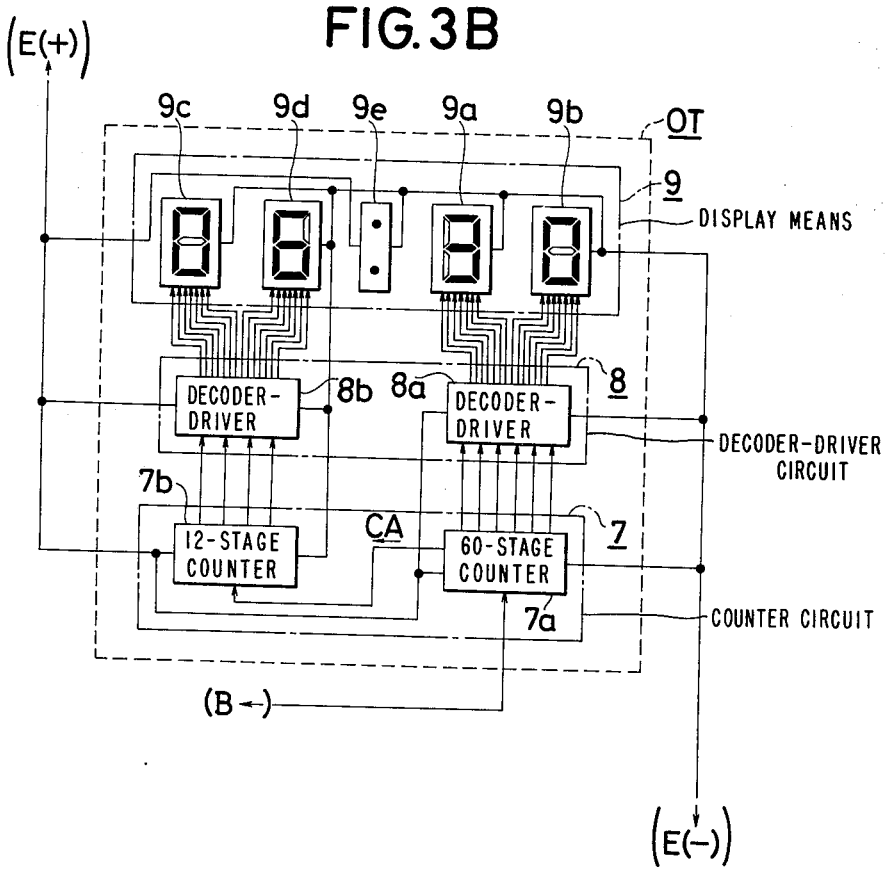
FIG. 3B is a schematic diagram, partly in block form, of the circuitry of the output device of FIG. 3A.

The details of the aforesaid output device OT is shown in FIG. 3B. At first, the aforesaid counter circuit 7 comprises a 60-stage counter **7*a* for counting the pulses supplied from the pulse oscillator OS to provide information representing minutes and to produce one carry signal CA every 60 pulses (corresponding to 1 hour) with simultaneous reset to zero and a 12-stage counter 7*b* for counting the carry signals CA supplied from said 60-scale counter 7*a* each in every 1 hour to provide information representing hours and to be reset in response to every 12 carry signals (corresponding to 12 hours). The decoder-driver circuit 8 comprises a decoder-driver 8*a* for converting the count of said 60-stage counter 7*a* to digital codes representing numerical values of minutes to drive display elements 9*a* and 9*b* for minute display in said display means 9 and a decoder-driver 8*b* for converting the count of said 12-stage counter 7*b* to digital codes representing numerical value of hours to drive display elements 9*c* and 9*d* for hour display. The display means 9 further includes a display element 9*e*** for dot display connected to the battery E.

Figure 4:
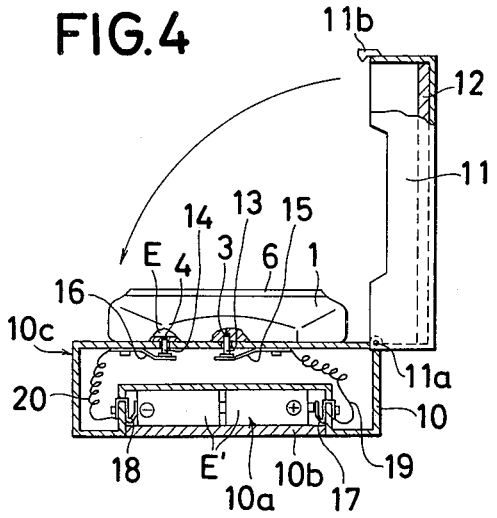
FIG. 4 is a sectional view of an example of the accessory device adapted for use with the above mentioned electronic watch to charge the electrical power source battery incorporated in said electronic watch.

Next, as the accessory devices usable with the electronic watch of such construction, at first, by reference to FIG. 4, there is explained an accessory device for charging the aforesaid electrical power source battery E.

In FIG. 4, 10 is a frame structure made of insulating material such as plastics and having a battery chamber **10*a* for accommodating two charging batteries E′ with a back cover 10*b* removably mounted thereon to permit exchange of said batteries E′. 11 is a top cover pivotally mounted on the frame structure 10 by pivot pins 11*a* and provided with a locking pawl 11*b* at a portion thereof engageable with a notch 10*c* formed in a portion of the frame structure 10, and with a cushion material 12 such as sponge mounted on the interior surface of the top cover 11 to hold the watch on the frame structure 10. 13 and 14 are connection terminals arranged on the upper surface of said frame structure 10 to mate with holes 1*a* and 1*b* formed in the casing 1 of the above mentioned electronic watch when the watch is placed on the frame structure 10 and biased by respective conductive plate springs 15 and 16 to outwardly project through the holes 1*a* and 1*b* into electrical contact with the respective connection terminals 3 and 4, and the aforesaid conductive plate springs 15 and 16 are connected to respective contact members 17 and 18 for the (+) and (−) electrodes of the aforesaid charging batteries E′ respectively through respective leads 19 and 20**.

Figure 5:
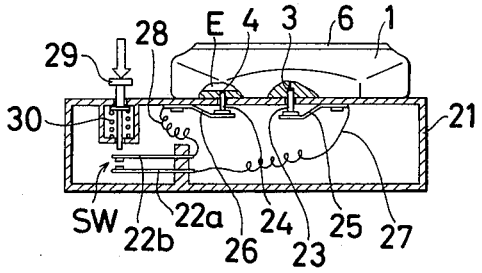
FIG. 5 is a sectional view of an example of the accessory device adapted for use with the above mentioned electronic watch to compensate clocking shift error of said electronic watch.

Next, by reference to FIG. 5, there is explained an accessory device for compensating clocking shift error of the above mentioned watch.

In FIG. 5, 21 is a frame structure made from insulating material such as plastics and provided with a switch SW mounted within said frame structure 21 and comprising two contacts **22*a* and 22*b*. 23 and 24 are connection terminals arranged on the upper surface of said frame structure 21 to mate with holes 1*a* and 1*b* formed in the casing 1 of the above mentioned electronic watch when the watch is placed on the frame structure 21 and biased by respective conductive plate springs 25 and 26 to outwardly project through the holes 1*a* and 1*b* into electrical contact with the respective connection terminals 3 and 4, and the aforesaid conductive plate springs 25 and 26 are connected to repective contacts 22*a* and 22*b* of the switch SW by way of leads 27 and 28 respectively. 29 is an operating button arranged on said frame structure 21 to manually close said switch SW and biased by a spring 30** to outwardly project.

The operation of the electronic watch of the aforesaid construction and the using methods of the aforesaid two accessory devices are as follows.

At first, the above mentioned electronic watch is assumed to operate normally. The transistors $Tr_1$ and $Tr_2$ constituting the pulse oscillator OS repeat alternative inversion at a predetermined frequency so that the potential of the electrical power source battery E and zero potential alternatively appear at points A and B to thereby produce timing pulses at the frequency (one each minute) which are then counted by the 60-scale counter **7*a* within the counter circuit 7 of the output device OT. The number of timing pulses counted by said 60-scale counter 7*a* is converted to the decoder-driver 8*a* connected to said 60-scale counter 7*a* to a corresponding digital code for driving the display elements 9*a* and 9*b* of minute display. On the other hand, the 12-scale counter 7*b* in the counter circuit 7 counts the number of carry signals CA produced from said 60-scale counter 7*a*, and the decoder driver 8*b* connected to said 12-scale counter 7*b* converts the counted number of said 12-scale counter 7*b* to a corresponding digital code for hour display and drives the display elements 9*c* and 9*d*** for hour display.

In a manner described above, the timing is carried out by the output device OT with the result that the display of the time is effected by the display means 9 of said output device OT.

When the voltage of the battery E incorporated in the above mentioned electronic watch is lowered below a predetermined level, said battery E can be charged by use of the charging accessory device shown in FIG. 4 in such a manner as follows. The above mentioned watch is placed on the upper surface of the frame structure 10 while the holes 1*a* and 1*b* formed in the casing 1 of the watch being brought into mating relation to respective connection terminals 13 and 14 projecting from the upper surface of the frame structure 10, and when the top cover 11 is turned in a direction indicated by arrow in FIG. 4 to the closed position, where the top cover 11 is locked to said frame structure 10 as its locking pawl 11*b* engages with the notch 11*c* formed in the frame structure 10 and where the watch is slightly pressed down by the cushion material 12 against the upper surface of the frame structure 10.

As the above mentioned connection terminals 13 and 1 tend to project from the upper surface of the frame structure 10 under the action of the plate springs 15 and 16 into electrical contact with the respective connection terminals 3 and 4 so that a current is allowed to flow from the positive electrode of the charging battery E' within the battery chamber 10*a* through contact 17, lead 19, conductive plate spring 15, connection terminal 13, contact member 3, diode $D_5$, the positive electrode of the incorporated battery E, the negative electrode of incorporated battery E, contact member 4, connection terminal 14, conductive plate spring 16, lead 20, contact member 18 to the negative electrode of the charging battery E', whereby the charging of the battery E incorporated in the watch is performed.

With the above mentioned electronic watch, when a clocking shift occurs, it is possible to compensate this clocking shift error by use of the watch compensating accessory device of FIG. 5 in such a manner as follows. The above mentioned watch is placed on the frame structure 21 while the holes 1*a* and 1*b* formed in the casing 1 being brought into mating relation to the respective connection terminals 23 and 24 projecting from the upper surface of said frame structure 21. At this time, said connection terminals 23 and 24 are caused to contact with the respective connection terminals 3 and 4 buried in the holes 1*a* and 1*b* of the casing 1 under the action of the respective conductive plate springs 25 and 26 so that the switch SW of the frame structure 21 is connected between the connection point B of the electronic watch, that is, the input terminal end B of the counter circuit 7 of the output device OT and the negative electrode of the incorporated battery E.

When the operating button 29 provided on the frame structure 21 is depressed against the force of the spring 30, the contacts 22*b* is brought into contact with the contact 22*a*, thereby the switch SW is closed to drop the potential at the input terminal B of the counter circuit 7 to zero despite of the fact that the pulse oscillator OS is operating. As a result, said counter circuit 7 makes no count to stop the clocking, thereby the clocking shift can be compensated provided that the clocking shift was in the advanced direction.

When the electronic watch is slow, the operating button 29 will be depressed a desired number of times at a higher frequency than that of the pulse oscillator in the watch, whereby the above mentioned point B is caused to take the potential of the battery E and zero potential alternatively as if the corresponding number of additional timing pulses are produced. Therefore, the watch goes fast the number of depressions of the operating button 29.

Next, by reference to FIGS. 6 and 7, another embodiment of the electronic watch according to the present invention will be explained.

Figure 6:
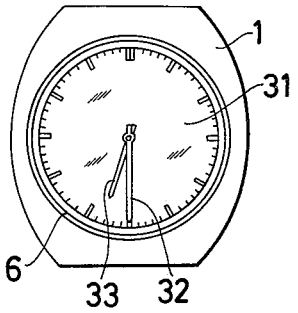
FIG. 6 is a elevational view of another embodiment of an electronic watch according to the present invention.
Figure 7:
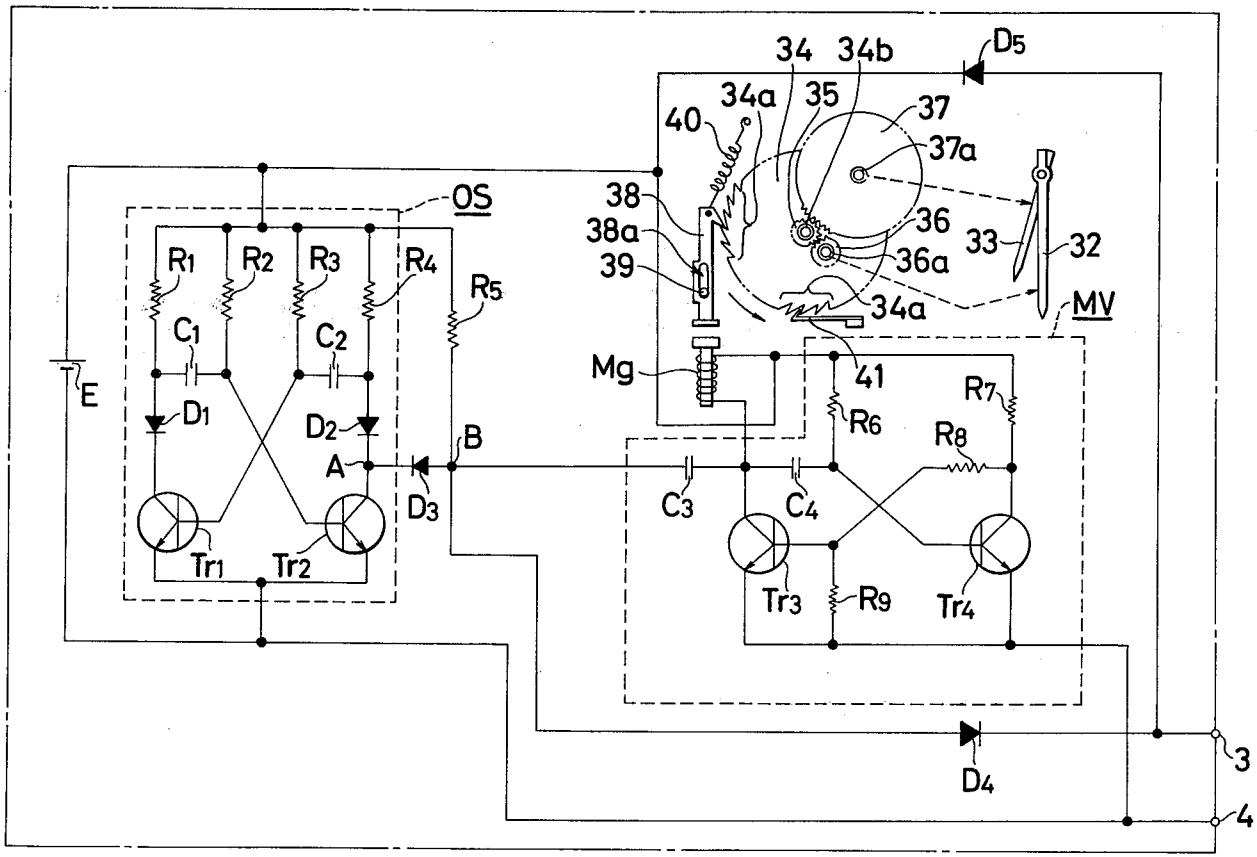
FIG. 7 is a schematic diagram of the electric circuit and mechanical device incorporated in the electronic watch of FIG. 6.

The second embodiment shown in FIGS. 6 and 7 is adapted to carry out the time indication by two hands. Except for the construction necessary for this time indication, the other construction is the same as that of the first embodiment, and therefore the same reference characters have been employed to denote the similar and like parts to those shown in FIGS. 1, 2 and 3.

At first, in FIG. 6, 31 is a time scale disc, and 32 and 33 are minute and hour hands respectively.

Next, in FIG. 7, 34 is a ratchet disk having 60 ratchet teeth 34*a* provided on the periphery thereof, 35 is a small gear connected to the output shaft 34*b* of the ratchet disk 34, 36 is a small gear engaging with said small gear 35 and having a diameter equal to that of the small gear 35. The above mentioned minute hand 32 is connected to the output shaft of the small gear 36. 37 is a gear designed to reduce the rotation of said ratchet disk 34 to 1/12 and engaging with said small gear 35. The above mentioned hour hand 33 is connected to the output shaft 37*a* of said reduction gear 37. 38 is a driving pawl arranged upon engagement with the ratchet teeth 34*a* of said ratchet disk 34 to drive said ratchet disk 34 for rotation. As a pin 39 planted on the watch body is engaged in an elongated slot 38*a* formed in a portion of the driving pawl 38, the pawl 38 is rendered slidingly movable in an almost vertical direction as viewed in the figure. Upon downward movement of the pawl 38, said ratchet disk 34 is driven for rotation in a direction of arrow. 40 is a spring urging said driving pawl 38 in a right upward direction as viewed in the figure, and 41 is a holding pawl for holding the ratchet disk 34 from rotation in the opposite direction to the above.

Mg is an electro-magnet connected to themono-stable multivibrator MV upon energization to attract the driving pawl 38 in the downward direction against the force of the spring 40. This mono-stable multivibrator MV has transistors $Tr_3$ and $Tr_4$, resistors $R_6$, $R_7$, $R_8$ and $R_9$ condensors $C_3$ and $C_4$ arranged upon response to the timing pulses from the above mentioned pulse oscillator OS to energize and deenergize and electromagnet Mg alternatively. In other words, as the condensor $C_3$ of said mono-stable multivibrator MV is connected to the connection point B, the transistors $Tr_3$ and $Tr_4$ repeat alternative inversion each time when a timing pulse from said pulse oscillator OS is applied to said condenser $C_3$, with the result that the electro-magnet Mg is energized at a rate of 1/min. by this energization of electromagnet Mg, the driving pawl 38 is moved downwards against the force of the spring 40 during which said ratchet disk 34 is being rotated through the length of 6° (that is, 1 minute) in the direction indicated by arrow.

By the particular use of this mono-stable multivibrator MV as the circuit for controlling actuation of said electro-magnet Mg, it is made possible to maintain constant the period of actuation of said electro-magnet Mg based on the depending upon the condensor $C_4$ and resistor $R_6$, and therefore, to adjust the period of energization of the electro-magnet Mg always to the value just necessary to rotate said ratchet disk 6° in response to the timing pulse despite of the fact that regardless of the magnitude of the pulse width of the limiting pulses applied to the connection point 8, that is, the input terminal of said mono-stable multi-vibrator MV. This is very advantageous to ensure that said driving pawl 38 operates with high accuracy and reliability.

The operation of the watch of FIGS. 6 and 7 is as follows. As the pulse oscillator OS produces timing pulses at a rate of one pulse per minute, the mono-stable multivibrator MV responsive to said timing pulses operates the electro-magnet Mg for cycles of energization and de-energization at a repitition rate of one cycle per minute. Upon energization of the electro-magnet Mg, the driving pawl 38 is moved downward as attracted against the force of the spring 40. During this attracting process, the ratchet disk 34 is driven for rotation through the angular distance of 6°. As the ratchet disk 34 rotates 6° every 1 minute, the minute hand 32 and hour hand 33 are driven through the respective gear 36 and 37 engaging the common gear 35 of said ratchet disk. As a result, the time is indicated relative to the time scale on the display disk 31.

The using methods of the accessory devices shown in FIGS. 4 and 5 for the purposes of charging the battery incorporated in the watch of FIGS. 6 and 7 and of compensating the clocking shift error of this watch are the same as those shown in connectionn with watch of FIGS. 1, 2 and 3.

It will be seen from the foregoing that the electronic watch or clock constructed in accordance of the invention is provided with electrical external connecting means adapted to charge the battery incorporated in the watch or clock and/or to electrically compensate the clocking shift error in combination with accessary devices for effecting the above mentioned functions, whereby the inconvenience which might be otherwise encountered when the batteries of watches or clocks of the type described are exchanged as in the prior art, and the accidental setting of the time which would be encountered when the operating member is carelessly brought into shocking contact with an external material body are all eliminated.

Although the embodiment of FIG. 4 has been explained as to use charging batteries E' contained in the frame structure 10 when the charging of the battery E incorporated in the watch is carried out, it is of course possible to modify the charging accessory device in a manner to utilize the home A.C. voltage source.

Further, although the embodiment of FIG. 5 has been explained as to require a number of repeated depressions of the operating button 29 in compensating the clocking shift error when the watch is slow, it is of course possible to use an additional pulse oscillator of a higher pulse frequency than that of the pulse oscillator incorporated in the watch as connected to the connection terminals 3 and 4 to thereby effect an equivalent result.

What is claimed is:

1. An electronic watch or clock comprising:

(A) a casing having a display window for time display;

(B) pulse generating means for producing timing pulses at a predetermined frequency;

(C) timing means for performing the timing based on said timing pulses produced from said pulse generating means, said timing means being incorporated within said casing and being electrically connected to said pulse generating means;

(D) display means for displaying the time, said display means being arranged in said casing to permit the display state to be viewed from said display window and being driven by said timing means in order to display the time;

(E) a chargeable electrical power source battery for supplying electrical power to said pulse generating means and to said timing means, said battery being incorporated within said casing and being connected to said pulse generating means and said timing means, said pulse generating means and said timing means being rendered operative with the electrical power supply from said battery; and (F) electrical external connecting means for making it possible to selectively perform either of the charging of said electrical power source battery and the electrical correction of the time displayed by said display means from the outside of said casing;

said connecting means being electrically connected to said battery and said timing means to supply an external electrical power to said battery and being arranged to cut off the supply of the timing pulses from said pulse generating means to said timing means and also to supply a pulse signal to said timing means with timing different from said timing pulses;

the electrical external connecting means thus being arranged not only to permit supply of the electrical power therethrough to the electrical power source battery for charging the battery but also to permit connection of a gaining or losing error of the time displayed by the display means by cutting off the supply of the timing pulses to the timing means or by supplying said pulse signal at the timing differing from said timing pulses.

2. An electronic watch or clock according to claim 1 wherein said electrical external connecting means includes:

a first terminal member electrically connected to a positive pole of said electrical power source battery through a first reverse current preventing diode for preventing a current from flowing to said first terminal member from said electrical power source battery and electrically connected to a point of connection between said pulse generating means and said timing means through a second reverse current preventing diode for preventing said external electrical power from being applied to said connection point; and a second terminal member electrically connected to a negative pulse of said electrical power source battery; said first and second terminal members being thus arranged not only to permit supply of the electrical power therethrough to the electrical power source battery for charging the battery but also to permit correction of a gaining error of the time displayed by said display means by short-circuiting said first and second terminal members to cut off the supply of the timing pulses from said pulse generating means when the displayed time has a gaining error and to permit correction of also a losing error of the displayed time by allowing said pulse signal to be supplied from outside to said timing means through the first and second terminal members at timing differing from said timing pulses of said pulse generating means when the displayed time has a losing error.

3. An electronic watch or clock comprising:

(A) a casing having a display window for time display;

(B) pulse generating means for producing timing pulses at a predetermined frequency;

(C) timing means for performing the timing based on said timing pulses produced from said pulse generating means, said timing means being incorporated within said casing and being electrically connected to said pulse generating means;

(D) display means for displaying the time, said display means being arranged in said casing to permit the display state to be viewed from said display window and being driven by said timing means in order to display the time;

(E) an electrical power source battery for providing electrical power to said pulse generating means and to said timing means, said battery being incorporated within said casing and being connected to said pulse generating means and said timing means, said pulse generating means and said timing means being rendered operative with electrical power supply from said battery; and (F) electrical external connecting means for making it possible to electrically correct the time displayed by said display means from the outside of said casing, said connecting means being electrically connected to said timing means to cut off the supply of the timing pulses from said pulse generating means to the timing means and to supply a pulse signal to the timing means with timing which differs from the timing of said timing pulses, the time displayed by the display means being arranged to be correctable for a gaining or losing error by cutting off the supply of the timing pulses to the timing means or by supplying said pulse signal to the timing means with the timing different from the lining pulse through said electrical external connecting means.

4. An electronic watch or clock according to claim 3, said electrical external connecting means including:

a first terminal member electrically connected to a point of connection between said pulse generating means and said timing means; and a second terminal member connected to ground, said first and second terminal members being arranged to be short-circuited to cut off the supply of the timing pulses from said pulse generating means to said timing means for correction of the time displayed by said display means when the displayed time has a gaining error, and said pulse signal being arranged to be supplied from the outside through said first and second terminal members to said timing means at timing different from the timing pulses produced by said pulse generating means in such a manner as to correct said displayed time when the displayed time has a losing error.

5. An electronic watch or clock according to claim 4, said display means includes light emitting means for displaying the time digitally, said light emitting means being electrically connected to said timing means and being electrically driven by said timing means in order to display the time.

6. An electronic watch or clock according to claim 5, said timing means including:

pulse counter circuit means for counting the number of timing pulses produced by said pulse generating means, said pulse counter circuit means being electrically connected to said pulse generating means and said electrical power source battery and being rendered operative with the electrical power supplied from said electrical power source battery; and decoder-driver circuit means for converting the count value of said pulse counter circuit means to a digital code for time display and for driving electrically said light emitting means for time display, said decoder-driver circuit means being electrically connected to said pulse counter circuit means, said light emitting means and said electrical power source battery and being rendered operative with the electrical power supplied from said electrical power source battery.

7. An electronic watch or clock according to claim 6, said pulse generating means including:

a multivibrator circuit rendered operative with the electrical power supplied from said electrical power source battery to produce said timing pulses, said multivibrator being electrically connected to said electrical power source battery, said pulse counter circuit means being electrically connected to said multivibrator circuit to count the number of timing pulses produced from said vibrator circuit.

8. An electronic watch or clock according to claim 4, said display means including:

display disk for time display arranged in alignment with the display window of said casing; and a plurality of hands indicating a time on said display disk, said hands being arranged to be viewed from the display window of said casing and being operatively connected to said timing means to be driven mechanically by said timing means in order to display the time.

9. An electronic watch or clock according to claim 8, said timing means including:

driving means responsive to said timing pulses produced from said pulse generating means for driving said hands, said driving means being operatively connected to said hand and being electrically connected to said pulse generating means and said electrical power source battery to be rendered operative by the electrical power supply from said electrical power source battery.

10. An electronic watch or clock according to claim 9, said pulse generating means including:

a multivibrator circuit rendered operative with the electrical power supplied from said electrical power source battery to produce said timing pulses, said multivibrator circuit being electrically connected to said electrical power source battery, said driving means being electrically connected to said multivibrator circuit upon response to the timing pulses produced from said vibrator circuit to drive said hands.

* * * * *